US006774853B2

(12) United States Patent
Wong et al.

(10) Patent No.: US 6,774,853 B2
(45) Date of Patent: Aug. 10, 2004

(54) DUAL-BAND PLANAR MONOPOLE ANTENNA WITH A U-SHAPED SLOT

(75) Inventors: Kin-Lu Wong, Kaosiung (TW); Saou-Wen Su, Taipei (TW)

(73) Assignee: Accton Technology Corporation (TW)

( * ) Notice: Subject to any disclaimer, the term of this patent is extended or adjusted under 35 U.S.C. 154(b) by 0 days.

(21) Appl. No.: 10/289,289

(22) Filed: Nov. 7, 2002

(65) Prior Publication Data

US 2004/0090366 A1 May 13, 2004

(51) Int. Cl.[7] ..... H01Q 1/38
(52) U.S. Cl. ..... 343/700 MS; 343/767
(58) Field of Search ..... 343/700 MS, 725, 343/767, 829, 831, 846, 795

(56) References Cited

U.S. PATENT DOCUMENTS 4,766,440 A * 8/1988 Gegan ..... 343/700 MS
5,400,041 A * 3/1995 Strickland ..... 343/700 MS

* cited by examiner

*Primary Examiner*—Shih-Chao Chen

(57) ABSTRACT

A dual-band planar monopole antenna mainly includes a microwave substrate, a radiating metallic element, a feeding point, a microstrip line, and a ground plane. The microwave substrate includes a first surface and a second surface. The radiating metallic element is printed on the first surface and has a U-shaped slot thereon. The feeding point is disposed on the radiating metallic element. The microstrip line is connected to the feeding point for signal transmission. The ground plane is printed on the second surface functioning as a ground. The opening of the U-shaped slot is facing the feeding point and separates the radiating metallic element into a first sub-metallic element and a second sub-metallic element for generating a lower operating frequency and a higher operating frequency.

8 Claims, 3 Drawing Sheets

DUAL-BAND PLANAR MONOPOLE ANTENNA WITH A U-SHAPED SLOT

BACKGROUND OF THE INVENTION

1. Field of the Invention

This invention generally relates to an antenna apparatus, and more particularly to a dual-band planar monopole antenna for use in a wireless local area network (WLAN) system.

2. Description of the Related Art

With the development of the communication industry in recent years, various communication products have been developed for different applications. In particular, wireless local area network (WLAN) products have been growing rapidly, and antenna designs adaptable to industrial standards are in a great demand. In conventional techniques, most antennas are capable of operating only in a single band, either 2.4 GHz or 5.2 GHz in WLAN devices, and the antennas typically require additional matching circuitry for matching the antennas such that the cost of the antennas inevitably increase. As the market allows the coexistence of both bands (2.4 GHz and 5.2 GHz), it is desirable to design a dual-band antenna that can be operated in the 2.4 GHz and 5.2 GHz bands for a WLAN system.

Accordingly, the present invention provides an antenna which is simple in structure, low in manufacturing cost, and operated in dual-band mode so as to meet the requirement of the application in WLAN system.

SUMMARY OF THE INVENTION

It is an object of the present invention to provide a dual-band planar monopole antenna which can be operated in a dual-band mode for a WLAN system.

It is another object of the present invention to provide a dual-band planar monopole antenna which is light in weight and small in size for being easily adapted to a WLAN product.

It is a still further object of the present invention to provide a dual-band planar monopole antenna, wherein the antenna's radiation pattern in the azimuth plane is substantially omnidirectional so as to suitably apply to the base stations or access points of a WLAN system.

In order to achieve the above objects, the present invention provides a dual-band planar monopole antenna, which is printed on a microwave substrate having a first surface and a second surface, wherein a radiating metallic element and a microstrip line are printed on the first surface, and a ground plane is printed on the second surface. The radiating metallic element has a stub portion, on which a feeding point is disposed, and a U-shaped slot, of which the opening facing the feeding point, for separating the radiating metallic element into a first sub-metallic element and a second sub-metallic element. The microstrip line is connected to the feeding point for signal transmission, and the ground plane printed on the second surface corresponds to an area of the first surface defined by the length of the microstrip line and the width of the substrate.

BRIEF DESCRIPTION OF THE DRAWINGS

Other objects, advantages, and novel features of the present invention will become more apparent from the following detailed description when taken in conjunction with the accompanying drawings.

DETAILED DESCRIPTION OF THE PREFERRED EMBODIMENT

Figure 1:
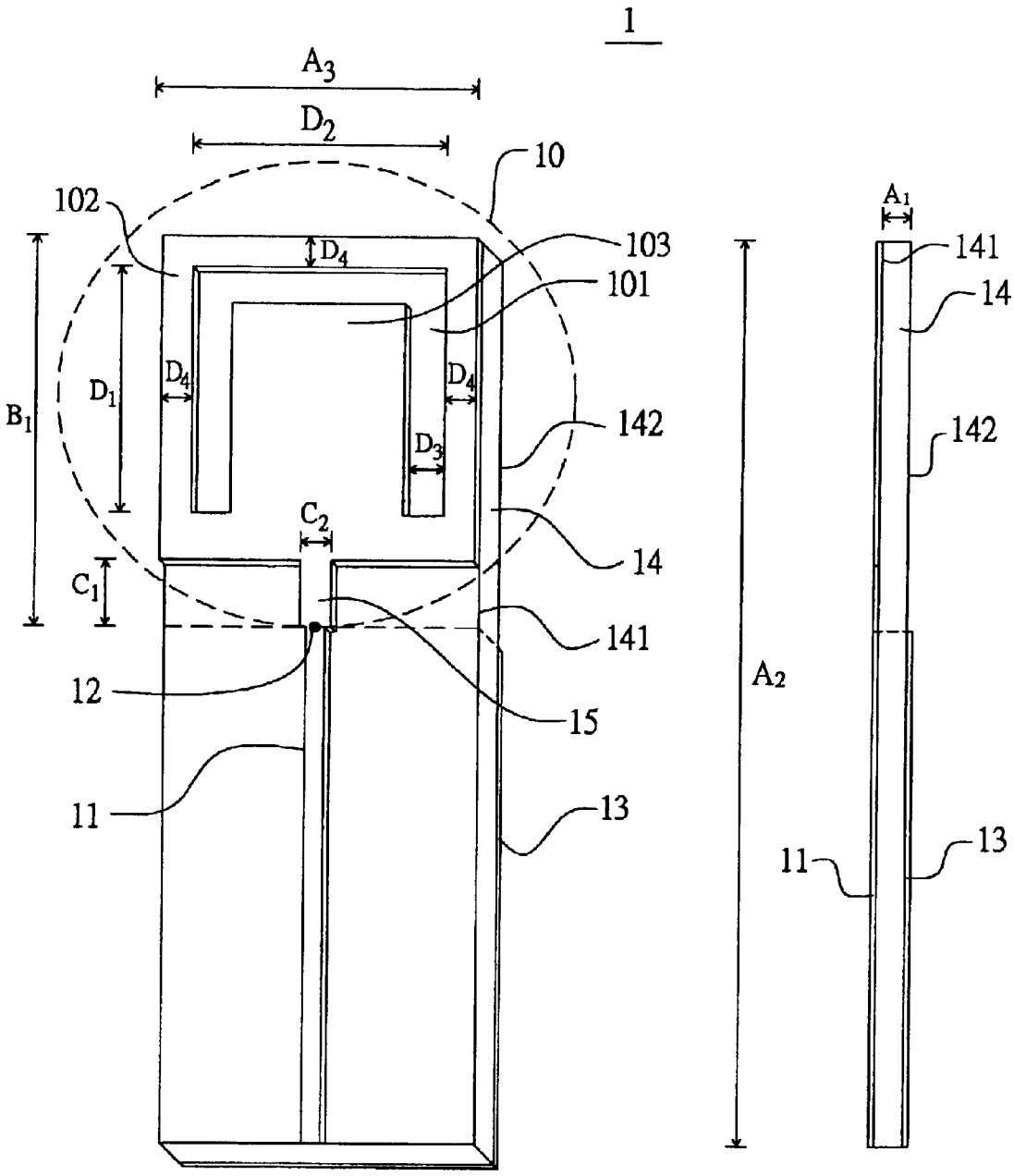
FIG. 1 shows a perspective view and sectional view of a dual-band planar monopole antenna in accordance with an embodiment of the present invention.

While the present invention is susceptible of embodiments in various forms, there is shown in the drawings and will hereinafter be described a presently preferred embodiment with the understanding that the present disclosure is to be considered an exemplification of the invention and is not intended to limit the invention to the specific embodiments illustrated.

Referring to FIG. 1, it shows a perspective view and sectional view of a dual-band planar monopole antenna in accordance with the present invention. It mainly includes: a microwave substrate 14, a radiating metallic element 10, a microstrip line 11, a feeding point 12, and a ground plane 13. The microwave substrate 14 includes a first surface 141 and a second surface 142. The radiating metallic element 10 is printed on the first surface 141, and the radiating metallic element 10 has a U-shaped slot 101 thereon and a stub portion 15 on which the feeding point 12 is disposed. The opening of the U-shaped slot is facing the feeding point 12 and separates the radiating metallic element 10 into a first sub-metallic element 102 and a second sub-metallic element 103, wherein the first sub-metallic element 102 substantially comprises the edge region of the radiating metallic element 10 for generating a lower operating frequency of the antenna, and the second sub-metallic element 103 substantially comprises the central region of the radiating metallic element 10 for generating a higher operating frequency of the antenna. The ground plane 13 is printed on the second surface 142 functioning as a ground. The microstrip line 11, preferably a microstrip line of characteristic impedance 50 Ω, has two ends wherein one end is connected to the feeding point 12 for signal transmission and the other end is connected to a SMA (SubMiniature version A) connector for being integrated with a WLAN system. The ground plane 13 is printed on the second surface 142 corresponding to the section of the first surface defined by the microstrip line.

It should be understood that the radiating metallic element can be etched on the first surface 141 of the microwave substrate 14 by etching techniques, and the microwave substrate 14 according to the present invention is formed as a printed circuit board made of BT (bismaleimide-triazine) resin, FR4 fiberglass reinforced epoxy resin, a flexible film substrate made of polyimide, or a substrate with good performance in high frequency made of polytetrafluoroethylene (Teflon) or ceramics e.g. $Al_2O_3$ or $MgTiO_3$.

As mentioned above, the path from the feeding point 12 to the edge region of the first sub-metallic element 102 forms the lower frequency resonant path of the antenna 1 in operation and determines the lower operating frequency of the antenna 1. In addition, the path from the feeding point 12 to central region of the second sub-metallic element 103 forms the higher frequency resonant path of the antenna 1 in operation and determines the higher operating frequency of the antenna 1. Since there is coupling between the lower frequency and the higher frequency resonant paths in the present invention, the lower and the higher operating frequencies for the desired dual-band WLAN operations can be easily tuned by adjusting the width and the length of the U-shaped slot.

Figure 2:
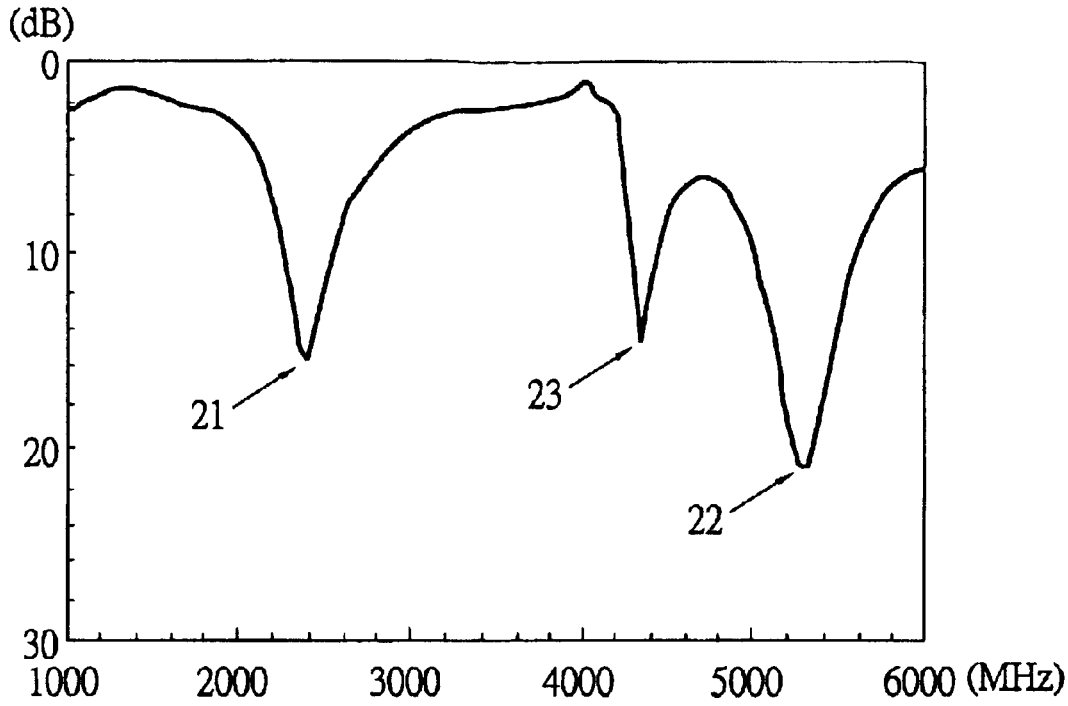
FIG. 2 is a diagram of the measured results showing the return loss of the dual-band planar monopole antenna in accordance with an embodiment of the present invention.
Figure 3:
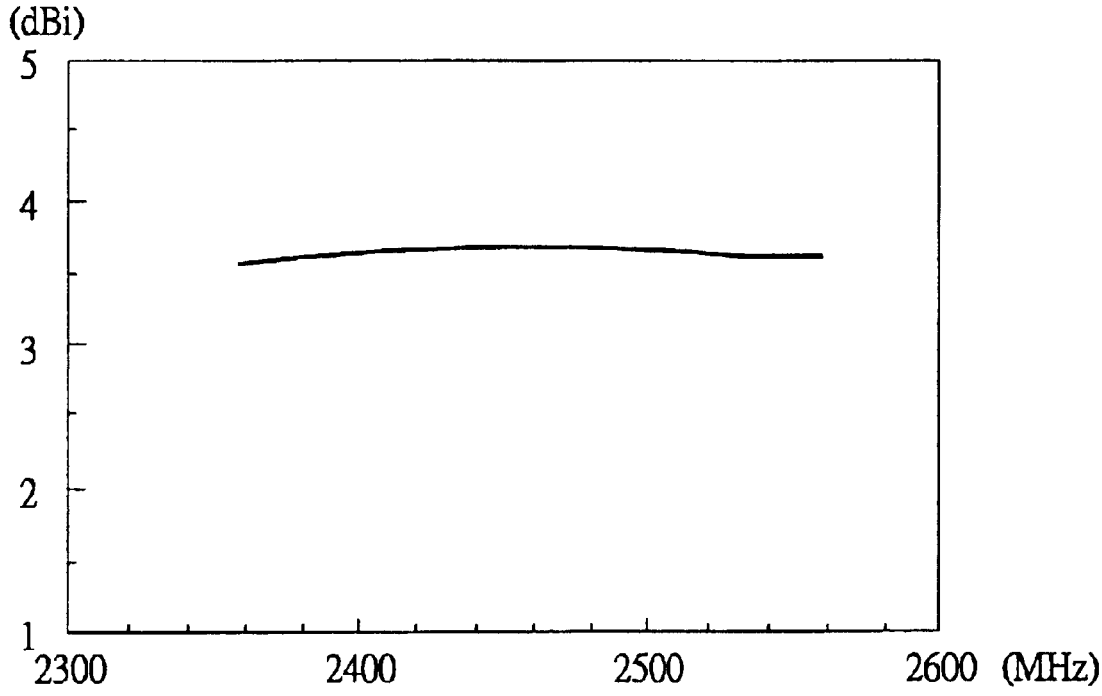
FIG. 3 is a diagram of the measured results showing the antenna gain of the dual-band planar monopole antenna in the 2.4 GHz band for WLAN operation in accordance with an embodiment of the present invention.
Figure 4:
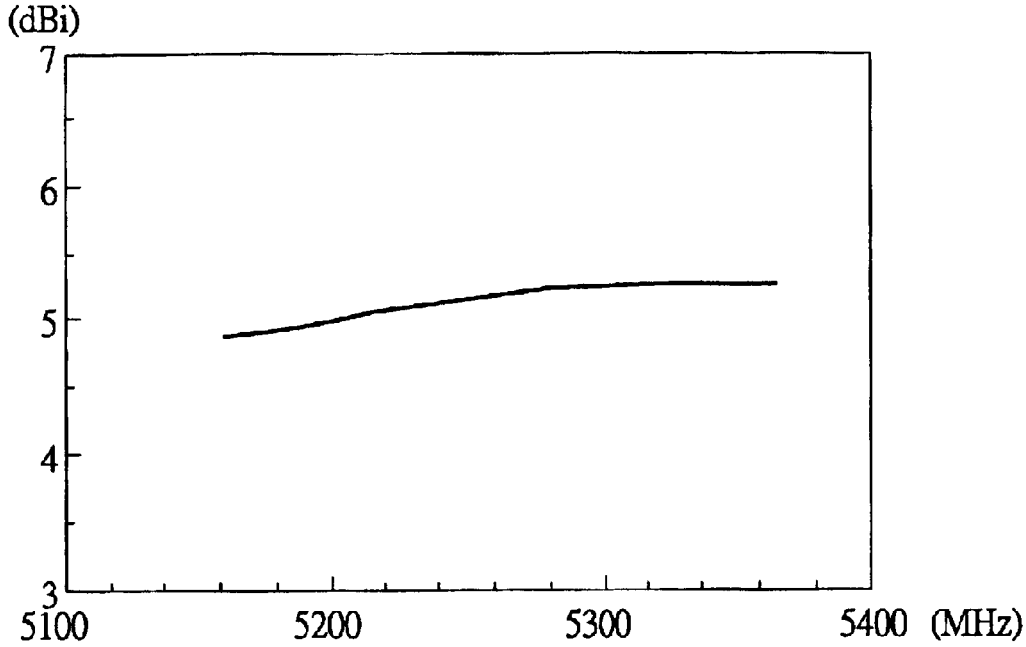
FIG. 4 is a diagram of the measured results showing the antenna gain of the dual-band planar monopole antenna in the 5.2 GHz band for WLAN operation in accordance with an embodiment of the present invention.

The experimental results of the dual-band planar monopole antenna 1 in accordance with the present invention are shown in FIG. 2 to FIG. 4. The experimental results in FIG. 2 to FIG. 4 are obtained under the condition that the microwave substrate 14 has a dielectric constant 4.4, and it is 0.4 mm in thickness (denoted by dimension $A_1$), 48 mm in length (denoted by dimension $A_2$), and 12 mm in width (denoted by dimension $A_3$). The radiating metallic element 10 is 19 mm in length (denoted by dimension $B_1$) and 12 mm in width (denoted by dimension $A_3$), in which the stub portion 15 is 4 mm in length (denoted by dimension $C_1$) and 0.8 mm in width (denoted by dimension $C_2$). The U-shaped slot is 11.5 mm in outer length (denoted by dimension $D_1$), 9 mm in outer width (denoted by dimension $D_2$) and 1.5 mm in line width (denoted by dimension $D_3$). The distance between the external edge of the U-shaped slot and the edge of the substrate is 1.5 mm (denoted by dimension $D_4$).

FIG. 2 depicts that, under the condition (definition) that the return loss equals to 10 dB, a lower frequency operating mode of the antenna 1 is 21 and a higher frequency operating mode is 22 as shown in FIG. 2. It can be seen that the bandwidths of the operating frequency 2.4 GHz (the lower frequency operating band) and 5.2 GHz (the higher frequency operating band) are 280 MHz and 600 MHz, respectively, wherein the operating bandwidth can meet the requirement of the bandwidth required for the 2.4 GHz (2.4–2.484 GHz) and 5.2 GHz (5.15–5.35 GHz) bands for WLAN operations. In addition, it should be noted that the resonant mode 23 between modes 21 and 22 is a harmonic resonant mode of the lower frequency operating mode 21. Compared with the operating mode 22, the bandwidth of the return loss impedance of the mode 23 is smaller, and the performance of the antenna radiation and the gain of the antenna are obviously ineffective, wherein the gain of the antenna is less than 2 dBi such that the mode 23 is not adapted to be operated in higher frequency operating band.

FIG. 3 and FIG. 4 depict the measured results of the antenna gain of the antenna 1 operated respectively in the 2.4 GHz band and 5.2 GHz band. In the 2.4 GHz band, the antenna gain can be up to 3.7 dBi, and in the 5.2 GHz band, the antenna gain can be up to 5.3 dBi. Thus it has been found that the antenna 1 in both of the lower frequency and higher frequency operating modes is provided with desirable antenna gain.

Figure 5A:
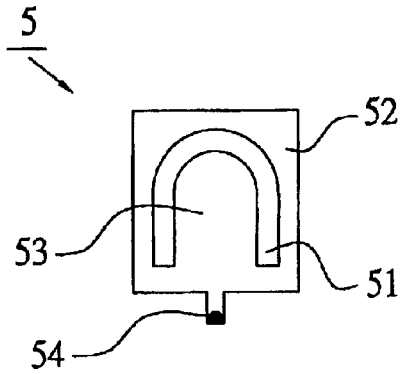
FIGS. 5*a*–5*c* are perspective views of the radiating metallic element of the dual-band planar monopole antennas in accordance with other embodiments of the present invention.
Figure 5B:
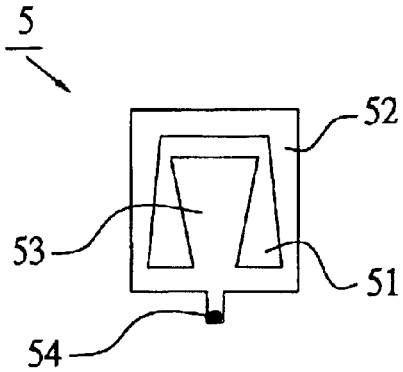
Figure 5C:
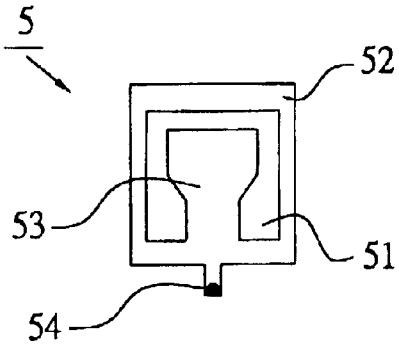

FIGS. 5*a*–5*c* depict perspective views of the radiating metallic element 5 of the dual-band planar monopole antenna of other embodiments in accordance with the present invention. The radiating metallic element 5 has a feeding point 54 disposed thereon and is separated into a first sub-metallic clement 52 and a second sub-metallic element 53 by a U-shaped slot 51. As shown in FIG. 5*a*, the slit of the U-shaped slot 51 is in the shape of an arc bend and the widths along the U-shaped slot 51 are substantially equal. In FIG. 5*b* and FIG. 5*c*, the widths along the U-shaped slot 51 are unequal.

Accordingly, in order to obtain the dual-band operation of the lower frequency operating mode and the higher frequency operating mode, any modification of the length, width, and form of the U-shaped slot 5 shown in FIG. 5*a* to FIG. 5*c* are possible, whereby a dual-band antenna adapted to the 2.4/5.2 GHz dual-band for WLAN is designed. In addition, both the resonant frequencies (the central frequencies of the lower frequency and higher frequency operating modes) can have good impedance matching without the need of equipping the antenna 1 of the present invention with additional matching circuits. Due to the simple planar structure, the manufacturing cost of the antenna is low, and it is easy to obtain the dual-band operation so as to meet the requirement of the WLAN system.

While the foregoing descriptions and drawings represent the preferred embodiments of the present invention, it should be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components. The presently disclosed embodiments are therefore to be considered in all respects as illustrative and not restrictive, and the scope of the invention should be defined by the appended claims and their legal equivalents, not limited to the foregoing descriptions.

What is claimed is:

1. A dual-band planar monopole antenna comprising:

a microwave substrate having a first surface and a second surface;

a radiating metallic element on the first surface having a U-shaped slot separating the radiating metallic element into a first sub-metallic element and a second sub-metallic element, and having a stub portion, wherein the first sub-metallic element substantially comprises the edge region of the radiating metallic element for generating a lower operating frequency, and the second sub-metallic element substantially comprises the central region of the radiating metallic element for generating a higher operating frequency;

feeding point disposed on the stub portion, the opening of the U-shaped slot facing the feeding point, wherein the feeding point is aligned to an area inside the opening of the U-shaped slot;

microstrip line on the first surface and connected to the feeding point for signal transmission; and ground plane located on a first portion of the second surface corresponding to a second portion of the first surface, wherein the microstrip line is located on the second portion of the first surface.

2. The dual-band planar monopole antenna as claimed in claim 1, wherein the radiating metallic element has a substantially rectangular shape.

3. The dual-band planar monopole antenna as claimed in claim 1, wherein the radiating metallic element is printed on the first surface.

4. The dual-band planar monopole antenna as claimed in claim 1, wherein the radiating metallic element is etched on the first surface.

5. The dual-band planar monopole antenna as claimed in claim 1, wherein the lower operating frequency of the antenna is substantially around 2.4 GHz, and the higher operating frequency of the antenna is substantially around 5.2 GHz.

6. The dual-band planar monopole antenna as claimed in claim 1, wherein the widths along the U-shaped slot are equal.

7. The dual-band planar monopole antenna as claimed in claim 1, wherein the widths along the U-shaped slot are unequal.

8. The dual-band planar monopole antenna as claimed in claim 1, wherein the feeding point is aligned to the center inside the opening of the U-shaped slot.

* * * * *